US005772087A

United States Patent [19]

Kolton

[11] Patent Number: 5,772,087

[45] Date of Patent: Jun. 30, 1998

[54] WALLET DISPLAY ASSEMBLY

[75] Inventor: Chester Kolton, Westfield, N.J.

[73] Assignee: B & G Plastics, Inc., Newark, N.J.

[21] Appl. No.: 848,526

[22] Filed: Apr. 28, 1997

[51] Int. Cl.[6] ..... A47G 25/14; A45C 13/06

[52] U.S. Cl. ..... 223/1; 223/87; 150/131

[58] Field of Search ..... 223/85, DIG. 1, 223/94, 89, 1, 88, 87; 150/131; 206/299, 278, 478

[56] References Cited

U.S. PATENT DOCUMENTS

| | | | |
|---|---|---|---|
| 2,835,300 | 5/1958 | Silha | 150/131 |
| 3,065,946 | 11/1962 | Berkow | 248/317 |
| 3,790,045 | 2/1974 | Rigel et al. | 223/87 |
| 5,123,577 | 6/1992 | Kolton et al. | 223/85 |
| 5,328,065 | 7/1994 | Kolton et al. | 223/85 |
| 5,429,284 | 7/1995 | Kolton et al. | 223/87 |
| 5,501,378 | 3/1996 | Kolton et al. | 223/87 |
| 5,620,118 | 4/1997 | Kolton et al. | 223/87 |

*Primary Examiner*—Bibhu Mohanty
*Attorney, Agent, or Firm*—Robin, Blecker & Daley

[57] ABSTRACT

A hanger is comprised of a one-piece body having a hook portion for the receipt of a display rod, a central portion depending from the hook portion, the body defining in the central portion a transverse opening therethrough fully bounded by the central portion, a fold line portion depending from the central portion and a flap segment depending from the fold line segment, the central portion, the fold line portion and the flap segment jointly defining a slot in the body which opens into a margin of the body. A wallet displayed by the hanger has a fold part disposed in the transverse opening and at least first and second parts extending from the fold part. The first part is disposed between hanger flap segment and the hanger central portion and the second part is disposed fully exteriorly of the hanger.

5 Claims, 2 Drawing Sheets

WALLET DISPLAY ASSEMBLY

FIELD OF THE INVENTION

This invention relates generally to a wallet display assembly and pertains more particularly to an assembly of a wallet with a hanger wherein the wallet may be inspected without need for removal from the hanger.

BACKGROUND OF THE INVENTION

By way of introduction to the subject invention, reference is made to commonly-assigned U.S. Pat. No. 5,429,284. This patent discloses a garment hanger comprised of a one-piece body having a hook portion for the receipt of a display rod, a central portion depending from the hook portion and having first and second openings therein, and a lower portion defining a fold line segment depending from the central portion with a third opening disposed in the fold line segment and a flap segment depending from the fold line segment. The central portion and the flap segment define coactive structure for retaining the flap segment against the central portion on folding of the flap segment about the fold line segment. The coactive structure is preferably comprised of first and second projections on the flap segment adjacent respective lateral margins thereof and first and second latching openings in the central portion adjacent respective lateral margins thereof.

In use of the hanger, with the flap segment unfolded, a garment, such as a tie, is looped through the first and second openings and then passed through the third opening. The flap is now folded against the garment and latched to the central portion.

By way of further introduction to the subject invention, reference is made to commonly-assigned U.S. Pat. No. 5,501,378, which discloses a garment hanger comprised of a one-piece body having a hook portion for the receipt of a display rod, a central portion depending from the hook portion, the body defining in the central portion an opening therethrough and a garment support member disposed in the opening and movable relative to the body and a lower portion defining a fold line segment depending from the central portion and a flap segment depending from the fold line segment, the central portion, the fold line segment and the flap segment jointly defining a slot in the body which opens into a margin of the body.

The central portion and the flap segment define coactive means for retaining the flap segment against the central portion on folding of the flap segment about the fold line segment.

The fold line segment is disposed contiguously with an interior end of the slot and provides cantilever support for the flap segment.

SUMMARY OF THE INVENTION

The present invention has as its primary object the provision of an assembly of a wallet with a hanger wherein the wallet may be inspected without need for removal from the hanger.

In attaining this and other objects, the invention provides, in combination, a hanger comprised of a one-piece body having a hook portion for the receipt of a display rod, a central portion depending from the hook portion, the body defining in the central portion a transverse opening therethrough fully bounded by the central portion, a fold line portion depending from the central portion and a flap segment contiguous with the fold line portion and secured to the central portion, and a wallet having a first part disposed in the transverse opening and at least second and third parts extending outwardly of the one-piece body, a portion of the wallet second part being disposed between the central portion and the flap segment, the wallet third part being disposed fully outwardly of the hanger.

The foregoing and other objects and features of the invention will be further evident from the following detailed description of a preferred embodiment thereof and from the drawings in which like components are identified by like reference numerals throughout.

DETAILED DESCRIPTION OF THE PREFERRED EMBODIMENT

Figure 2:
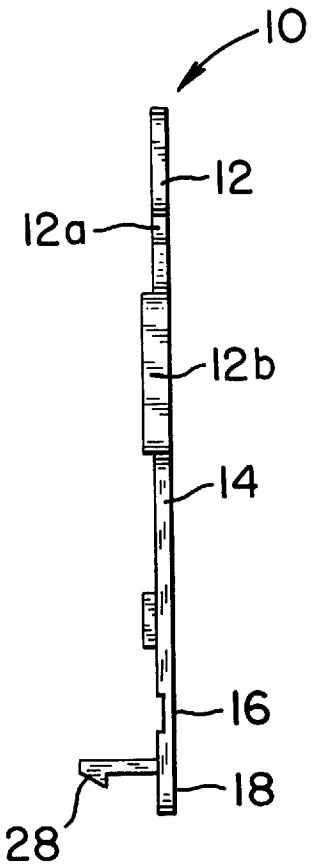
FIG. 2 is a right side elevational view of the FIG. 1 hanger.
Figure 1:
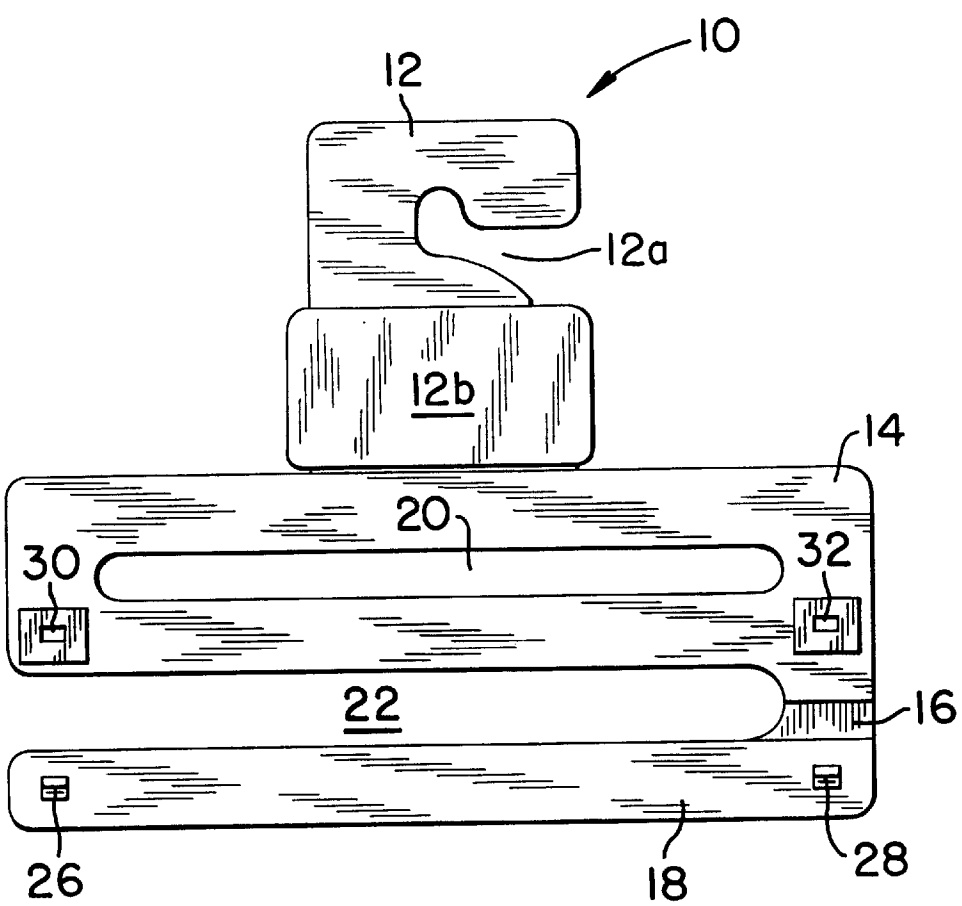
FIG. 1 is a rear elevational view of a hanger in accordance with the invention prior to its assembly with n wallet to be hung for display.

Referring to FIGS. 1 and 2, hanger 10 in accordance with the invention is comprised of a one-piece body having a hook portion 12 with a channel 12*a* for the receipt of a display rod and with a logo display area 12*b*, a central portion 14 depending from the hook portion, a fold portion 16 depending from the central portion and a flap segment 18 depending from fold portion 16 and cantilever-supported thereby. Fold portion 16 is constituted by thinning out the one-piece body to have a lesser thickness than the thickness of central portion 14 and flap segment 18, as is shown in FIG. 2.

The body defines in central portion 14 a transverse opening 20 therethrough, fully bounded by central portion 14. Central portion 14, fold line portion 16 and flap segment 18 collectively define slot 22 in the body which opens into a margin of the body.

Central portion 14 and flap segment 18 define coactive means for securing the flap segment against the central portion. The coactive means is preferably comprised of first and second projections 26 and 28 on flap segment 18 adjacent respective lateral margins thereof and first and second latching openings 30 and 32 in the central portion adjacent respective lateral margins thereof.

While the hanger may be constructed such that the coactive means is releasable, it is preferred that the retention not be releasable and that cutting is required to remove a wallet from the hanger.

Figure 3:
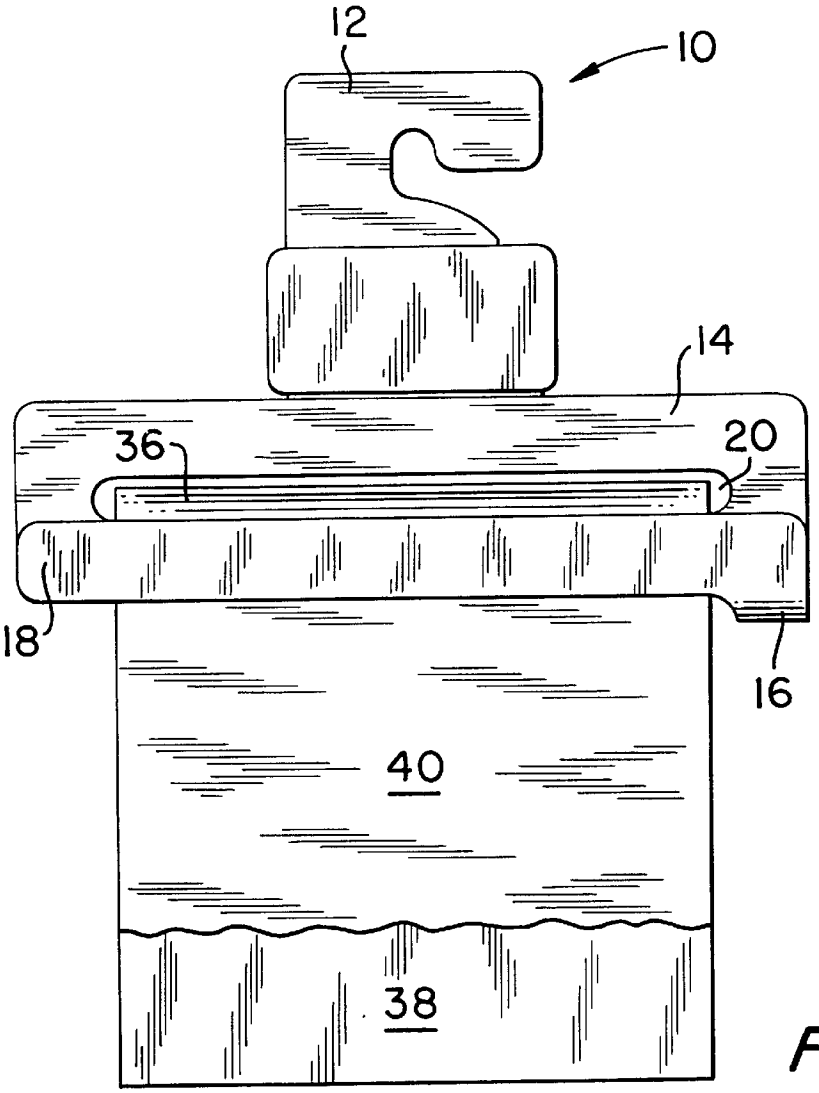
FIG. 3 is a rear elevational view of the hanger of FIGS. 1 and 2 assembled with a wallet.

In FIG. 3, hanger 10 is shown in assembly with wallet 34 with the wallet partly broken away. In reaching the assembly of FIG. 3, wallet part 38 is inserted, free end first, into opening 20 of hanger 10 until fold part 36 is resident in opening 20. At this juncture, wallet part 40 is placed in slot 18, the placement being facilitated by the cantilever-support of flap segment 18 by fold portion 16. Wallet part 38 is disposed fully exteriorly of hanger 10. Flap segment 18 is now folded about fold portion 16, i.e., onto wallet part 40, wallet fold part 36 being ensnared between flap segment 18 and hanger central portion 14 upon engagement of projections 26 and 28 and latching openings 30 and 32.

As will be appreciated, upon rotation of the FIG. 3 assembly by one-hundred and eighty degrees, hook portion 12 is insertable onto a display rod from the right hand side of the rod and wallet part 38 is fully viewable to a shopper and may be lifted for shopper inspection of the wallet without need for disassembly of the wallet and hanger. Upon lifting of wallet part 38, wallet part 40 is likewise fully viewable.

Various changes to the particularly disclosed embodiment and practices may evidently be introduced without departing from the invention. By way of example, the illustrated latching structure is used for applications in which high security is desired and may be replaced with other latching structure in other applications. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. In combination, a hanger comprised of a one-piece body having a hook portion for the receipt of a display rod, a central portion depending from the hook portion, the body defining in the central portion a transverse opening therethrough fully bounded by the central portion, a fold line portion depending from the central portion and a flap segment contiguous with the fold line portion and secured to the central portion, and a wallet having a first part disposed in the transverse opening and at least second and third parts extending outwardly of the one-piece body, a portion of the wallet second part being disposed between the central portion and the flap segment, the wallet third part being disposed fully outwardly of the hanger.

2. The invention claimed in claim 1, wherein said central portion and said flap segment define coactive means for retaining said flap segment against said central portion on folding of said flap segment about said fold line portion.

3. The invention claimed in claim 1, wherein said fold line portion is contiguous with an interior end of said slot and provides cantilever support for said flap segment.

4. The invention hanger claimed in claim 2, wherein said coactive means is comprised of at least one projection on said flap segment and at least one latching opening in said central portion.

5. The invention claimed in claim 2, wherein said coactive means is comprised of first and second projections on said flap segment adjacent respective lateral margins thereof and first and second latching openings in said central portion adjacent respective lateral margins thereof.

* * * * *